US006079992A

United States Patent [19]

Kuchar et al.

[11] Patent Number: 6,079,992

[45] Date of Patent: Jun. 27, 2000

[54] TRACK LIGHTING FIXTURE

[75] Inventors: James Kuchar, Fall River; Anthony C. Donato, Wellesley, both of Mass.; Alejandro Meir-Langner, Providence, R.I.

[73] Assignee: Genlyte Thomas Group LLC, Louisville, Ky.

[21] Appl. No.: 08/955,330

[22] Filed: Oct. 21, 1997

[51] Int. Cl.[7] ..... H01R 25/00

[52] U.S. Cl. ..... 439/122; 439/110; 362/287

[58] Field of Search ..... 439/110–122; 362/287.8

[56] References Cited

U.S. PATENT DOCUMENTS

| | | | |
|---|---|---|---|
| 4,776,809 | 10/1988 | Hall | 439/116 |
| 5,702,177 | 12/1997 | Lin | 362/266 |
| 5,788,518 | 8/1998 | Wachter et al. | 439/121 |

*Primary Examiner*—Lincoln Donovan

[57] ABSTRACT

An adapter is disclosed which allows the secure installation of a lighting fixture to a lighting track and which lies flush with the face of the track in its locked condition. The adapter includes a pair of wing-like pull down levers pivotably mounted to a base. A resilient retention member is engaged by cam walls extending from the lever so that when the lever is pivoted to a flush, locking position the resilient members are moved transversely outwardly and become wedged against the inner walls of the lighting track, thereby to secure the adapter to the track. The lighting fixture can be locked in a desired horizontal and vertical orientation by the operation of a single actuator arm. Rotation of the actuator arm from an unlocked to a locked position causes two friction plates to come into engagement, thereby to establish a braking action that prevents further movement of the lighting fixture in the vertical direction, and also moves a pair of clamps into operative engagement with the lighting fixture, thereby to limit its horizontal rotation.

19 Claims, 12 Drawing Sheets

TRACK LIGHTING FIXTURE

TECHNICAL FIELD

The present invention relates generally to lighting fixtures, and more particularly to an improved track lighting fixture.

BACKGROUND OF THE INVENTION

Track lighting systems and fixtures are used both in private houses and in public buildings, such as museums and commercial establishments, to provide ample illumination by the use of attractive components that blend well into the surrounding room design and decor. A conventional track lighting system includes a lighting track mounted to or in a ceiling. The lighting track typically includes a pair of buss bars consisting of a neutral line and a hot or voltage line. A lamp carried within a suitable socket is electrically connected to the buss bars and is mechanically secured to the lighting track by means of a fixture adapter from which the lamp socket extends downwardly from the lighting track and ceiling. Track lighting fixtures of this general type are described in, for example, U.S. Pat. Nos. 4,919,625 and 5,334,037.

In order to achieve a more pleasing appearance of a track lighting fixture, it is desirable for the fixture adapter to lie as flush as possible with the face or entry side of the lighting track section. Currently available fixture adapters, however, project by a perceptible distance below the face of the track section.

The currently available fixture adapters are generally difficult to install and to remove. A further difficulty that has been experienced with the known track lighting fixtures is that the force needed to remove the adapter from the lighting track is often sufficiently great to cause damage to the track mounting surface such as by loosening or bending the track supports in the ceiling or by digging into the ceiling surface. Moreover, in some of the currently available track lighting fixtures, replacing a lighting fixture may create safety problems.

In order to achieve optimum light orientation and distribution from a track lighting fixture, the lighting fixture is often aimed, that is, moved horizontally and vertically to a desired orientation. Aiming of the fixture is typically done when it is first installed and when it is located or aimed. In most conventional track lighting fixtures, it is difficult to lock and maintain the lighting fixture in the desired orientation after it has been aimed. Those track lighting fixtures that do permit the aimed fixture to be readily locked in a desired orientation are usually single-function operations, which often make it more difficult to achieve the desired orientation of the lighting fixture.

In order to create a variety of possible lighting effects, media accessories such as colored filters and diffusion filters and louvers and lenses of different sizes are often attached onto the lighting fixture by means of springs or other types of accessory holding devices. These devices are sometimes cumbersome and often do not permit several lighting media accessories to be used in conjunction with one another to provide a desired lighting effect.

SUMMARY OF THE INVENTION

It is an object of the invention to provide an adapter for use in a track lighting fixture that can be arranged substantially flush with the lighting track.

It is a further object of the invention to provide a lighting fixture adapter that can be readily inserted into a lighting track and which provides secure mechanical retention of the adapter in the lighting track as well as a reliable electrical connection.

It is a further object of the invention to provide a lighting fixture adapter which cannot be mechanically disengaged while it is electrically powered.

It is another object of the invention to provide a lighting fixture adapter that can be readily and safely disengaged from the track to allow the lighting fixture or lamp socket to be moved to a new position along the track or to change or reaim the lamp.

It is yet a further object of the invention to provide a track lighting fixture in which desired horizontal and vertical positions of the lighting fixture can be locked in place by the use of a single control member.

It is yet another object of the invention to provide a track lighting fixture in which a number of media accessories can be loaded and removed without disturbing the aiming adjustment of the accessories.

To these ends, the present invention provides a fixture adapter which allows for the secure installation of a lighting fixture into a lighting track, and in which the adapter, when installed, lies flush with the face end of the track. The adapter includes a pair of wing-like pull down levers pivotably mounted to a base. The pull down levers include flat surfaces and vertical cam walls. A resilient retention member is engaged by the cam wall so that when the pull down lever is pivoted to a clamp or locking position the resilient members are caused to be moved transversely outward and become wedged against a longitudinal rib within the track section, thereby to secure the adapter to the track section. To release the adapter from the track section, the levers are pivoted downwardly to cause the resilient wedge members to move inwardly away from their wedged, locking positions within the track housing.

The adapter may further include a rotatable contact post which includes two vertically spaced contacts. The contact post is rotated by the operation of a lever into and out of electrical contact with parallel buss bars in the track section. In one aspect of the invention, the electrical contact to the buss bars must be disengaged before the pull-down levers of the adapter can be pivoted downward to unlock the adapter, either to remove the adapter and lighting fixture or to move the fixture to a new position along the track section. The contact post cannot be rotated to the energizing position until the pull-down lever is pivoted upward into a locking position above the contact post lever to lock the lighting fixture in the track section.

In another aspect of the invention, the lighting fixture can be locked into a desired horizontal and vertical orientation by the operation of a single actuator arm. The actuator arm includes a plurality of raised surfaces received in a corresponding plurality of inclined recesses formed in an adjoining plate. Rotation of the actuator arm from the unlocked to the locked position creates a camming effect between the raised surfaces moving within the cam plate to cause inward axial movement of the latter. That axial movement causes two friction discs to come into contact to establish a braking action to prevent further movement of the fixture in the vertical direction and also moves a pair of clamps into a clamping engagement around a cylindrical stem member, thereby to limit horizontal rotation of the fixture.

In another aspect of the invention, a plurality of media accessories, such as a lens or a color filter, are mounted in a unitary cartridge that includes a plurality of spaced locating and locking devices arranged about its periphery. These devices engage mating elements in a cartridge sleeve arranged in the interior of the fixture so as to permit only one possible orientation of the cartridge in the fixture housing. The media accessories can be rotated in the cartridge to achieve the desired lighting effect, which is maintained by locking the accessories in the cartridge in a single orientation. The cartridge can be removed and re-assembled into the cartridge sleeve without changing the original and desired lighting effect.

BRIEF DESCRIPTION OF THE DRAWINGS

To the accomplishment of the foregoing and other objects as may hereinafter appear, the present invention relates to a track lighting fixture as defined in the appended claims, and as described in the following specification as considered with the accompanying drawings, in which:

DESCRIPTION OF THE PREFERRED EMBODIMENT

Figure 1:
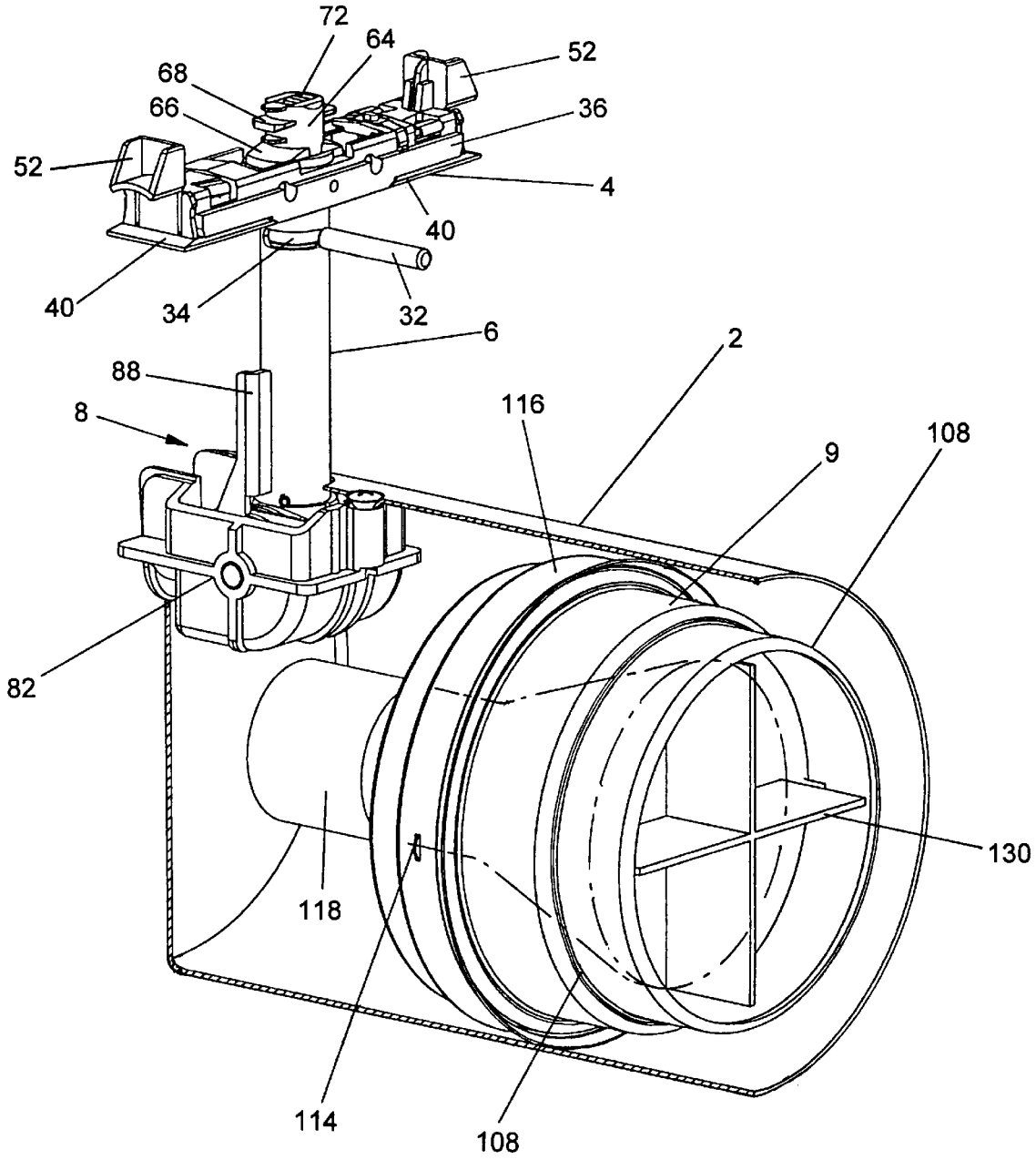
FIG. 1 is a perspective view of the fixture adapter, locking mechanism and media accessory cartridge according to an embodiment of the invention arranged with a lamp socket.
Figure 2:
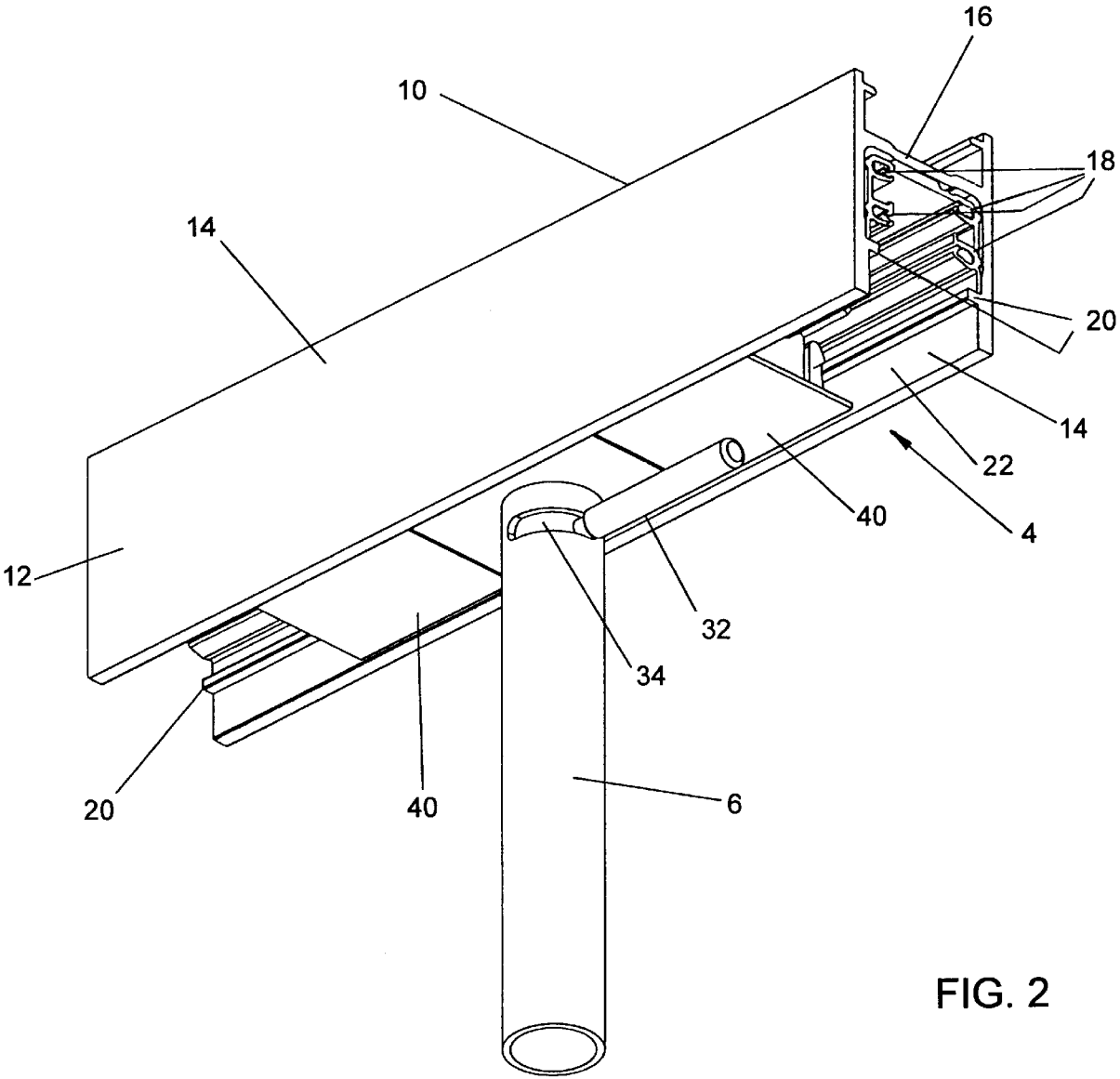
FIG. 2 is a perspective view of a lighting track in which the track fixture adapter of the present invention is installed.
Figure 3:
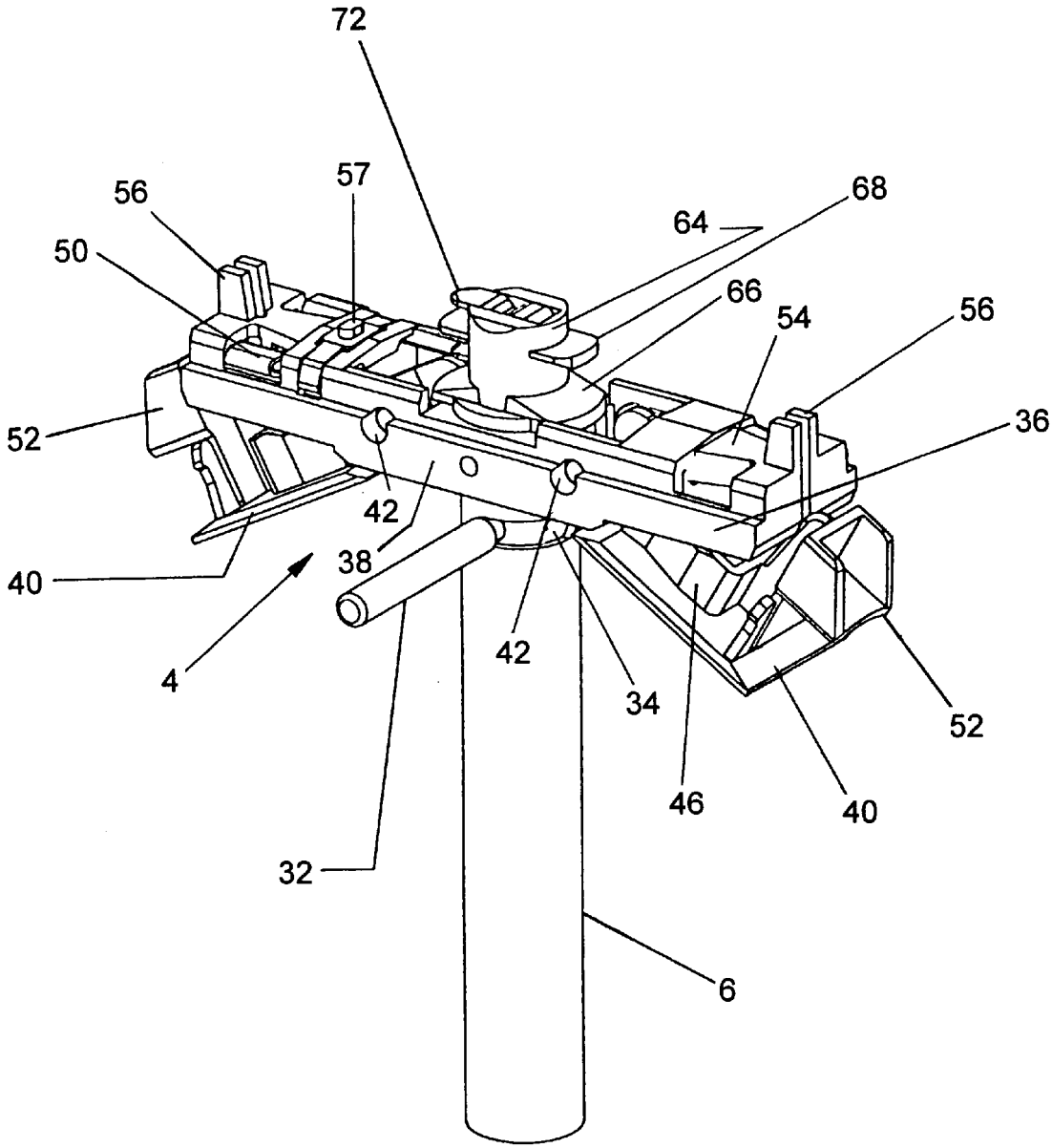
FIG. 3 is a perspective view of the fixture adapter of the invention.

FIG. 1 illustrates a lighting fixture or lamp housing 2 that is designed to be mounted and secured within a lighting track 10 (FIG. 2) by means of a fixture adapter 4. The fixture adapter 4 is secured to the upper end of a stem 6, the lower end of which is secured to a locking mechanism 8, which, as described below, allows the light fixture to be locked in a desired orientation. A media cartridge 9, also described below, allows a plurality of media accessories to be accurately oriented within the light fixture 2. The lighting track 10, which is adapted to be mounted either within or on the surface of a ceiling, includes, as seen in FIG. 2, an insulated liner or track body 12 that includes a pair of parallel vertical walls 14 spaced by transverse web 16. As seen in FIGS. 2 and 3, the inner surface of each side wall 14 includes a pair of spaced conductors buss bars 18 extending along the length of the liner. Each pair of buss bars includes a ground or neutral line and a voltage or hot line. A track rib 20 extends below the buss bars 18 along the length of the lighting track 10. An elongated channel 22 is formed along the length of the lighting track 10 below the track rib 20.

In accordance with one aspect of the invention, the fixture adapter 4, which is described in greater detail in a later part of this specification, is capable of being mounted flush with the lower end of channel 22 of the lighting track 10 as shown in FIG. 2. As described in detail below, the adapter 4 also provides electrical connection of lighting fixture 2 to the buss bars 18 in the lighting track by the manual rotation of an electrical engagement lever 32 within the confines of a peripheral slot 34 formed at the upper end of stem 6.

Figure 4:
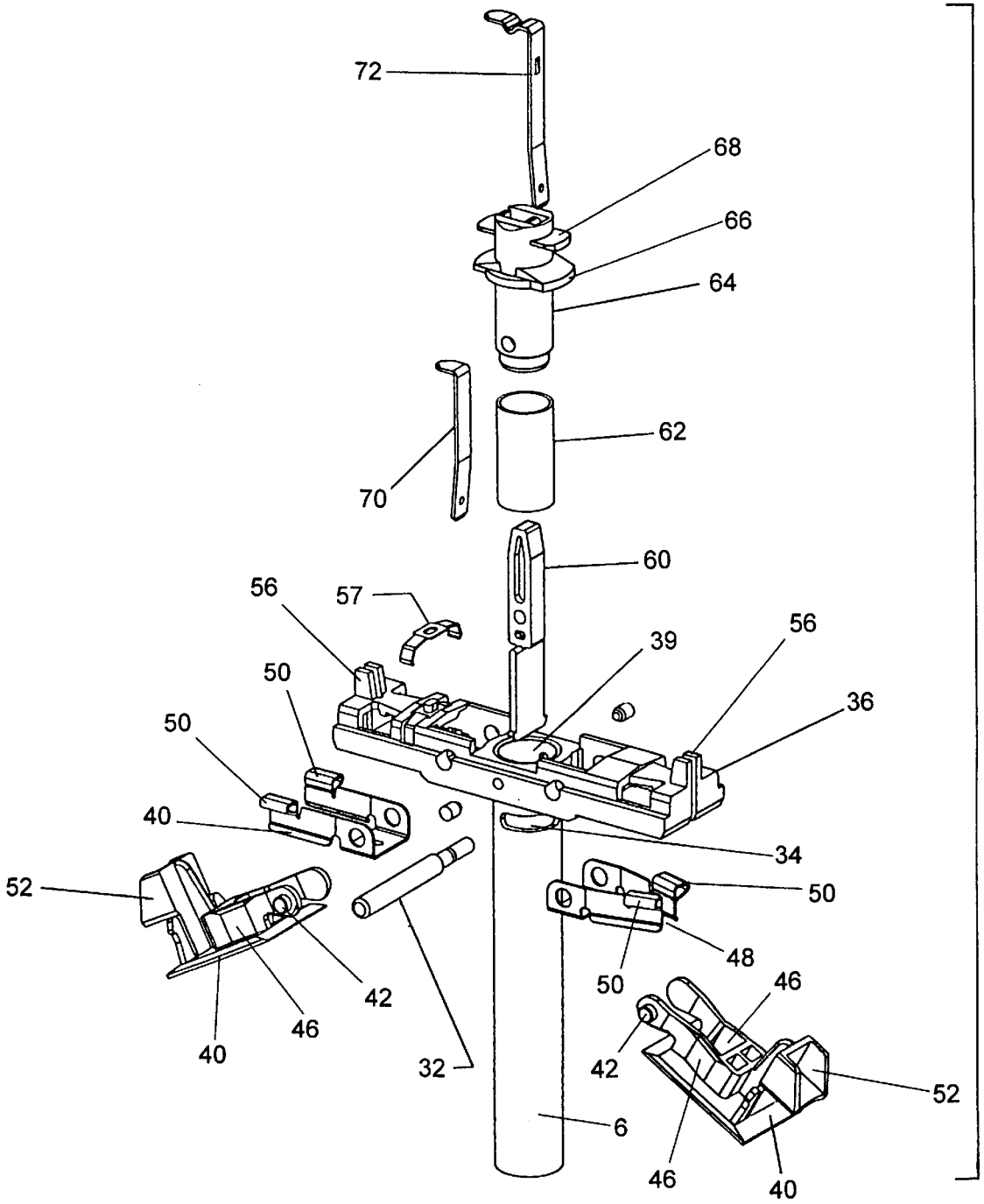
FIG. 4 is an exploded view of the fixture adapter of the invention.

As seen in FIGS. 3 and 4, the fixture adapter 4 includes a base 36 made of an electrically conductive material such as aluminum mounted on the upper end of stem 6. Base 36 includes spaced side walls 38 and a central opening 39. A pair of opposed, wing-like pull-down levers 40 are pivotably mounted at pins 42 to the base. As seen best in FIGS. 9A and 9B, the pull-down levers 40 each includes a flat lower surface 44 and a pair of tapered vertical spring support walls 46. Also mounted on each pivot pin 42 is a mechanical support spring 48 that includes a bowed or curved transverse section 50. Spring 48 is received within a recess 58 formed in the upper surface of base 36.

Figure 7B:
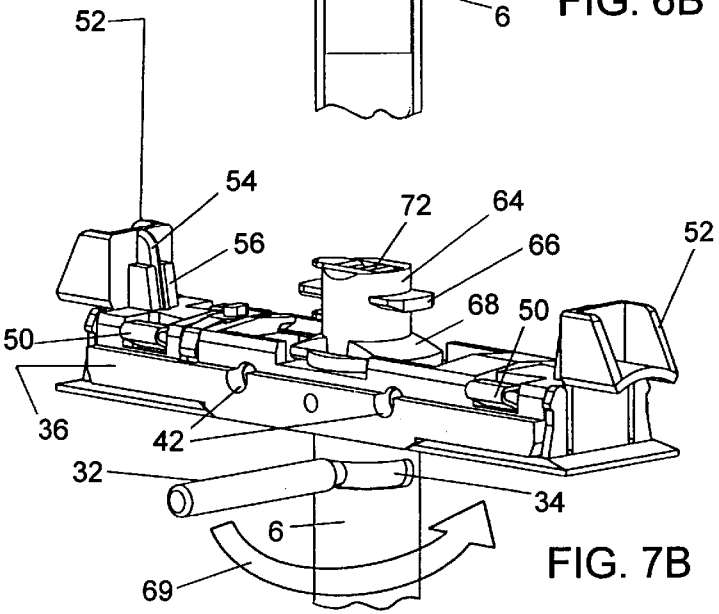
FIGS. 7A and 7B are perspective views of the fixture adapter of the invention in its energized and neutral positions respectively.
Figure 7A:
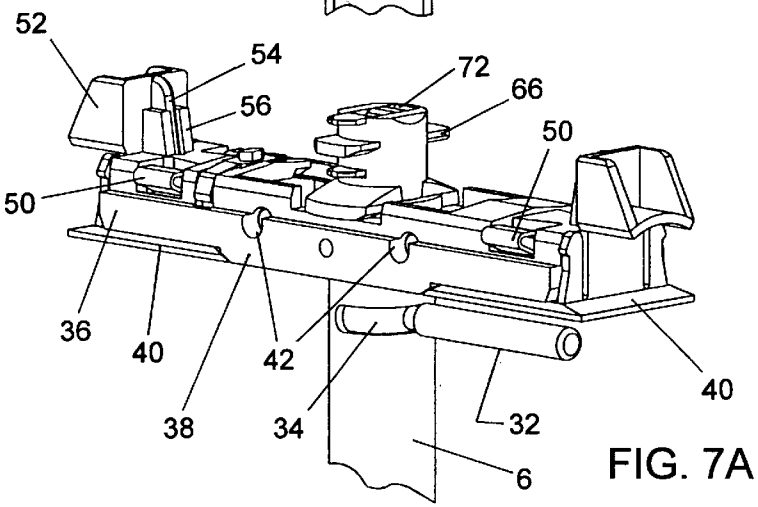

The fixture adapter 4 further includes, as seen in FIGS. 7A and 7B, a pair of end fingers 52 affixed at the outer ends of each of the pull-down levers 40. A rib 54 projects from the inner surface of each of the fingers 52 and a pair of spaced posts 56 is provided at each end of the upper surface of base 36. As is per se conventional, a ground spring 57 is placed in another recess in the upper surface of adapter base 36.

As seen best in FIG. 4, a contact support structure secured to the upper end of stem 6 extends through opening 40 in adapter base 36. That structure includes an internal insulation post 60 over which is fitted an insulation tube 62. A contact support post 64 that includes vertically spaced mounting tabs 66, 68 is received within the upper end of tube 62. One end of a neutral contact 70 extends radially from the contact post 64 and a hot or voltage contact 72 is received within an opening in the upper end of post 64 so that the free end of contact 72 projects from the upper end of the contact support post 64.

Figure 6B:
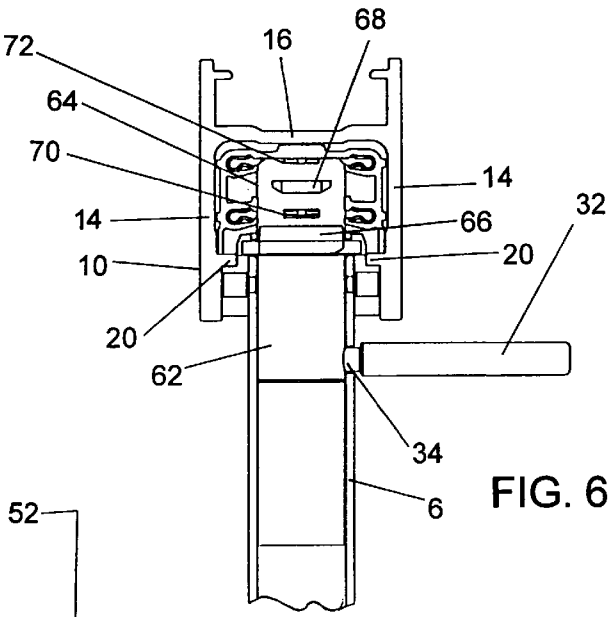
FIGS. 6A and 6B are elevation views in cross-section respectively illustrating the fixture adapter of the invention in its energized and neutral positions within the lighting track.
Figure 8B:
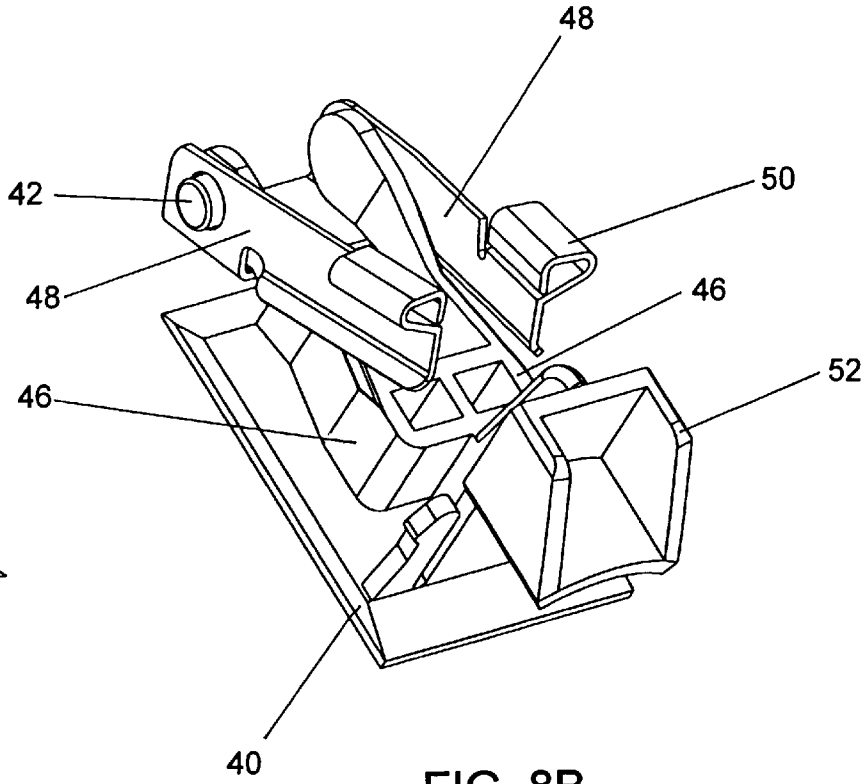
FIGS. 8A and 8B are perspective views, on an enlarged scale as compared to FIG. 7, of the pull down lever of the fixture adapter of the invention respectively in its locking and nonclamped positions.

To secure the fixture adapter 4 to the lighting track section 10, the upper end of the adapter is inserted into the channel 22 with the pull-down levers 40 in their nonclamped or neutral position shown in FIGS. 3 and 8B. At this time, the engagement lever 32 and contacts 70, 72 are in their nonelectrified or neutral positions shown in FIGS. 3, 6B and 7B. The pull down levers 40 are then pivoted about pins 42 to cause them to snap into the track or mechanically engaged position shown in FIGS. 2 and 7B. As pull down levers 40 are pivoted upwardly, spring support walls 46 move upward relative to the inner surfaces of the support springs 48.

Figure 5:
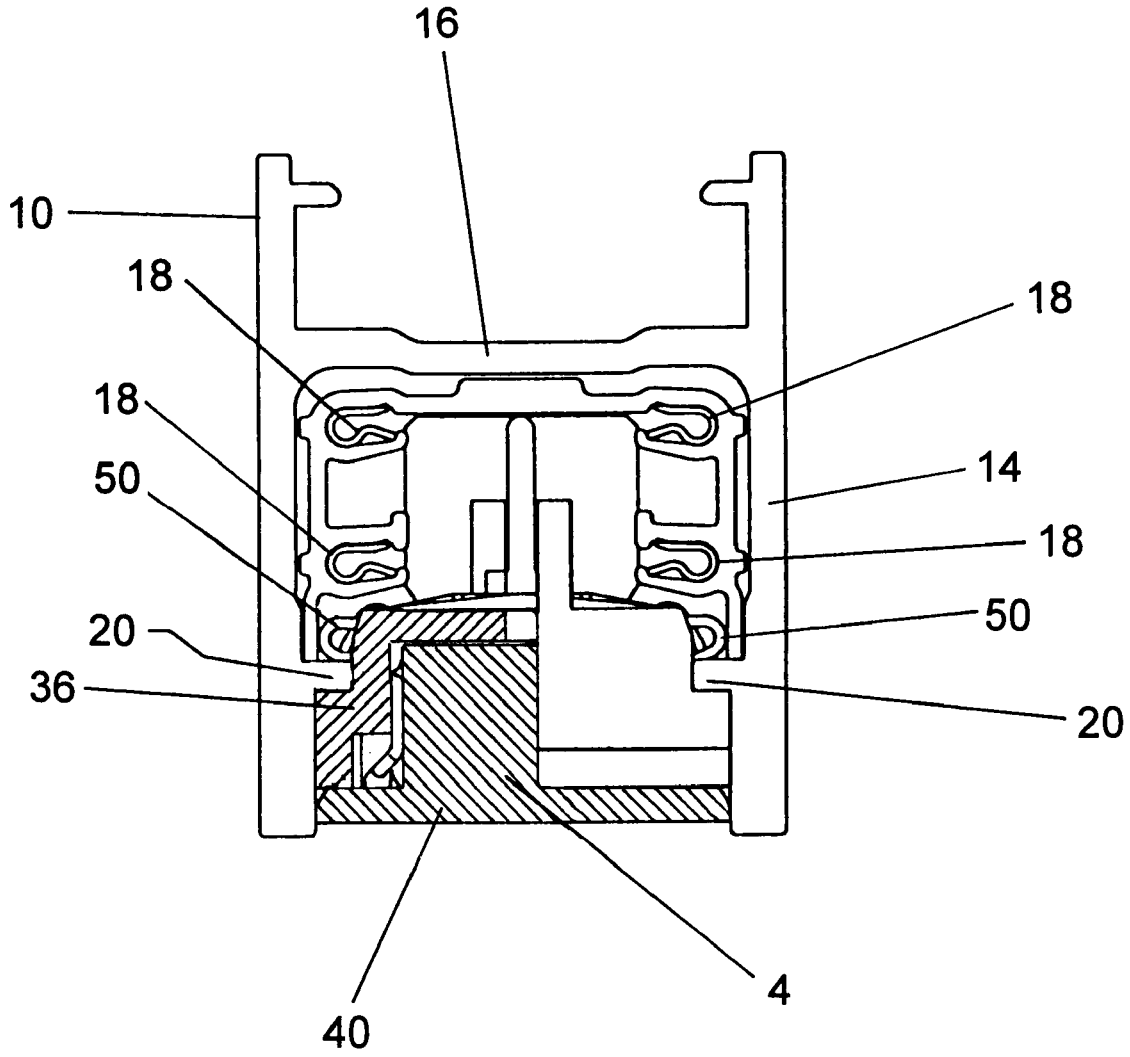
FIG. 5 is a cross-section of a lighting track in which the fixture adapter of the invention is received and connected.
Figure 8A:
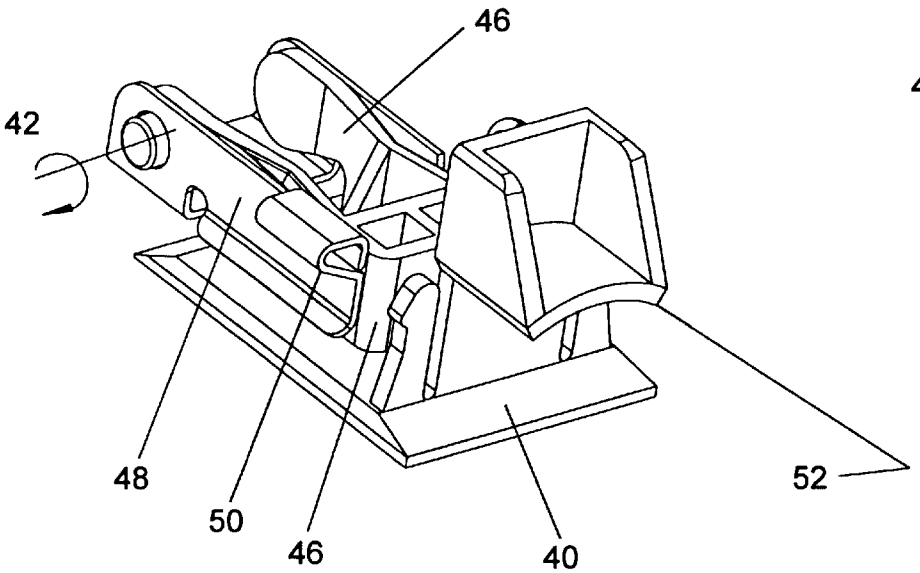

As the pull down levers 40 are pivoted further upwards, the springs 48 including the bowed section 50 are increasingly urged outwardly by the camming force of the spring support walls 46 against the support springs 48 until the pull down levers 40 are in their fully raised, flush position shown in FIGS. 7B and 8A. At this time, the spring sections 50 are extended to their maximum transverse position in which, as seen best in FIG. 5, they are wedged horizontally against the inner track side wall 14 and vertically against the track rib 20. At this time the lever end fingers 52 are also wedged against the track rib 20. The engagement of the support springs 50 and fingers 52 with the inner wall of the lighting track in this manner securely retains the fixture adapter 4 within the lighting track. As shown in FIG. 2, in this position of the fixture adapter 4, its lower surface, primarily the lower flat wall sections of the pull down lever 40, are substantially flush with the lower end of the lighting track 10 as desired.

Figure 6A:
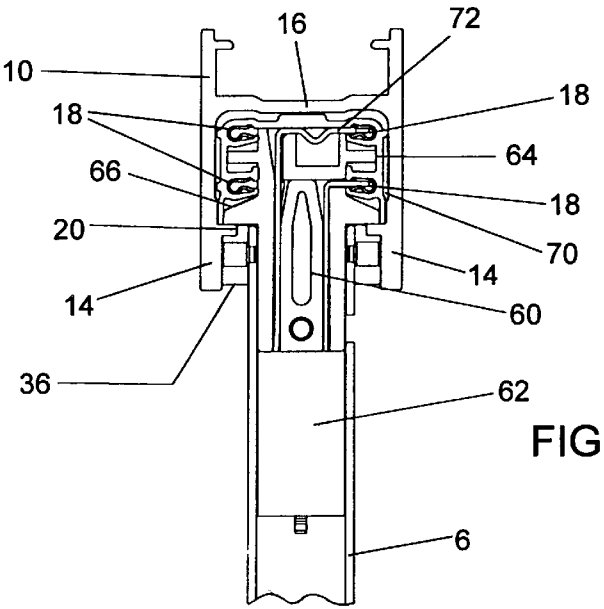

Once the fixture adapter 4 is secured into the lighting track 10, as described, electrical connections of the fixture can be made to the buss bars 18 in the lighting track 10 by rotating the electrical engagement lever 32 within slot 34 in the direction of the arrow 69 (FIG. 7B) from the neutral position (FIG. 7B) to the energized position (FIG. 7A) to, in turn, rotate the contact post 64 to the energized position shown in FIG. 6A. In this position of the contact post 64, the tabs 66, 68 engage the transverse rib 20 of the lighting track, and the contacts 70, 72 respectively make electrical contact with the ground and hot buss bars 18. The rotation of the engagement lever 32 to this position is blocked by the pull down levers 40 when they are in their nonclamped or neutral position shown in FIG. 8B, so that electrical connection of the light fixture to the lighting track 10 is prevented until the fixture adapter 4 is secured or locked into the lighting track, that is, when at least one of the pull down lever 40 has been moved upward to the clamp position shown in FIG. 8A. Lever 32 must be turned to deenergize the lighting fixture before the fixture can be removed from the lighting track.

In another aspect of the invention, a locking mechanism 8 is provided at the lower end of the stem 6 to which the lighting fixture 2 is affixed to lock the stem 6 and lighting fixture 2 in the desired vertical and horizontal positions. As is conventional, as shown in FIG. 9, the lower end of stem 6 is threadably engaged with a support cage 82 by means of a hold bushing 84, which, as seen in FIG. 9, is secured to the lighting fixture 2.

Figure 9:
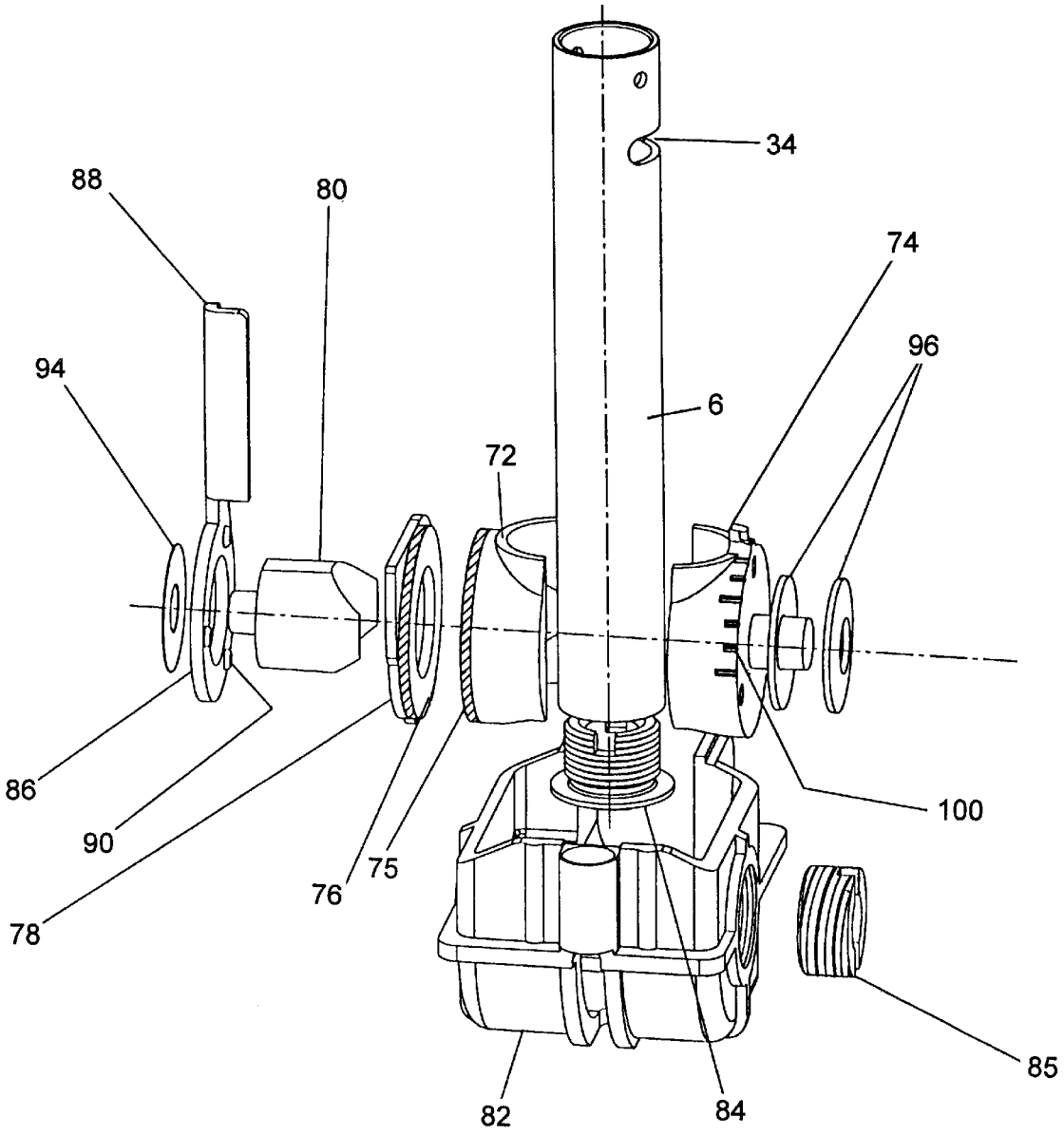
FIGS. 9 is a perspective partly exploded view of a locking mechanism in accordance with the invention.

As seen in FIG. 9, the locking mechanism 8 includes a pair of opposed stop clamps 72, 74 whose inner arcuate surfaces are arranged about the lower end of stem 6. A first friction or brake lining 75 is affixed to the outer surface of clamp 72 and a second friction or brake lining 76 is secured to an inner surface of a ramp plate 78. An inner barrel 80 having a curved inner surface extends through central openings in plates 72, 75, 76 and 78 and engages the lower end of stem 6. The outer reduced-diameter portion of inner barrel 80 is received within an opening formed in a lever disk 86, which is integral with an actuator arm 88.

Figures 10A, 10B, 10C:
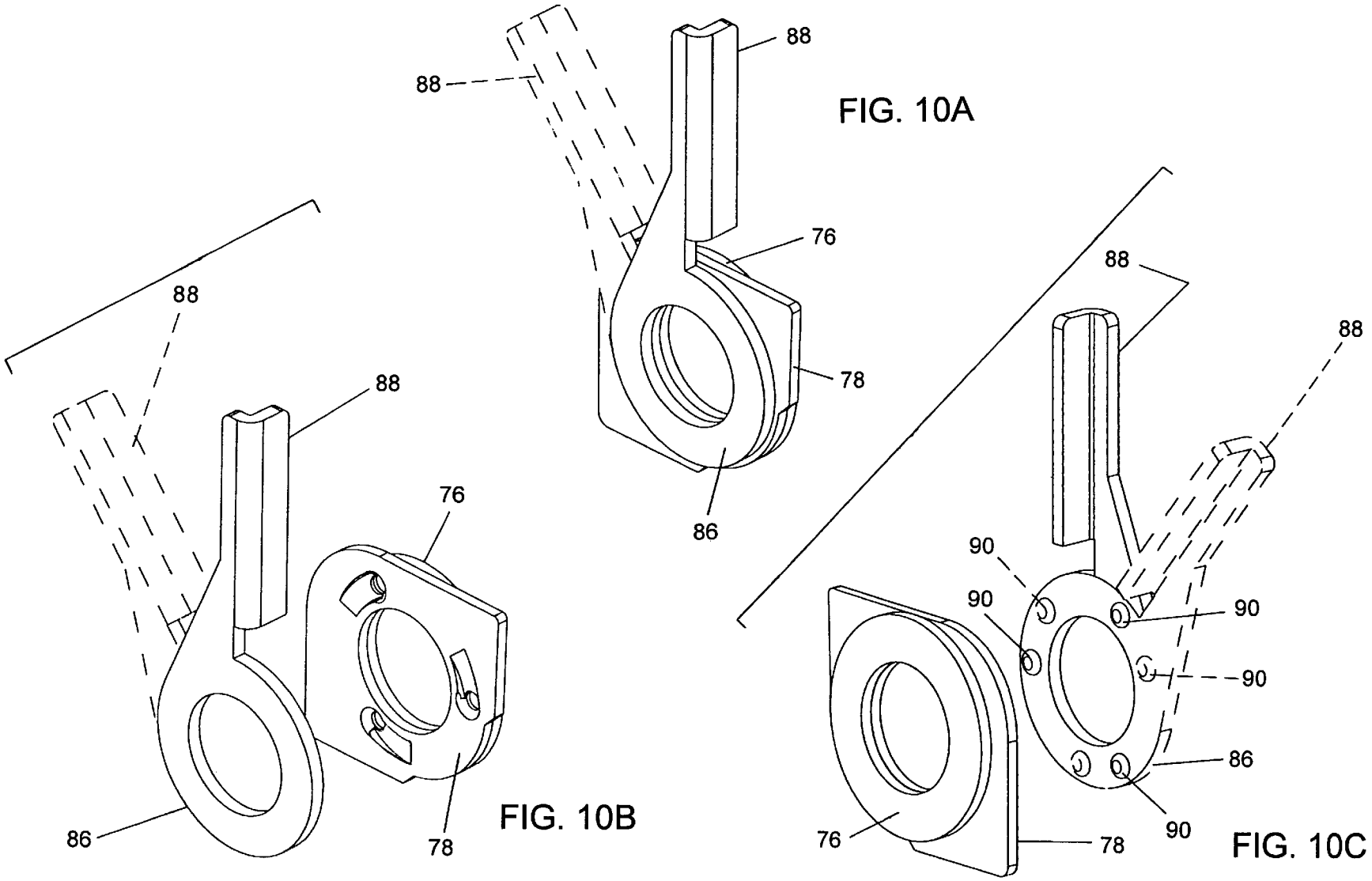
FIGS. 10A, 10B, and 10C are perspective views illustrating the construction and operation of the ramp plate, activating lever and brake plates of the locking mechanism of FIG. 9.

As seen best in FIGS. 9 and 10, a plurality (here three), of equiangularly spaced bumps 90 project from the inner surface of lever disk 86. A corresponding plurality of sloping or inclined arcuate recess 92 are formed in the outer surface of ramp plate 78. A shim washer 94 is placed on the reduced-diameter end of inner barrel 80, and a pair of spring washers 96 are placed about the outwardly extending central pin 98 of stop clamp 74. A plurality of angular division indicia 100 are arranged about the outer periphery of stop clamp 74.

To aim the lighting fixture, that is, to move it into a desired position, the lighting fixture is manually rotated about stem 6 horizontally and vertically. During this positioning of the lighting fixture, the actuator lever 88 is in its open position shown in solid lines in FIGS. 10A, 10B and 10C and in broken lines in FIG. 11 at which time the brake linings 75, 76 are spaced apart and the stop clamps 72, 74 are spaced from the periphery of the stem 6.

Figure 11:
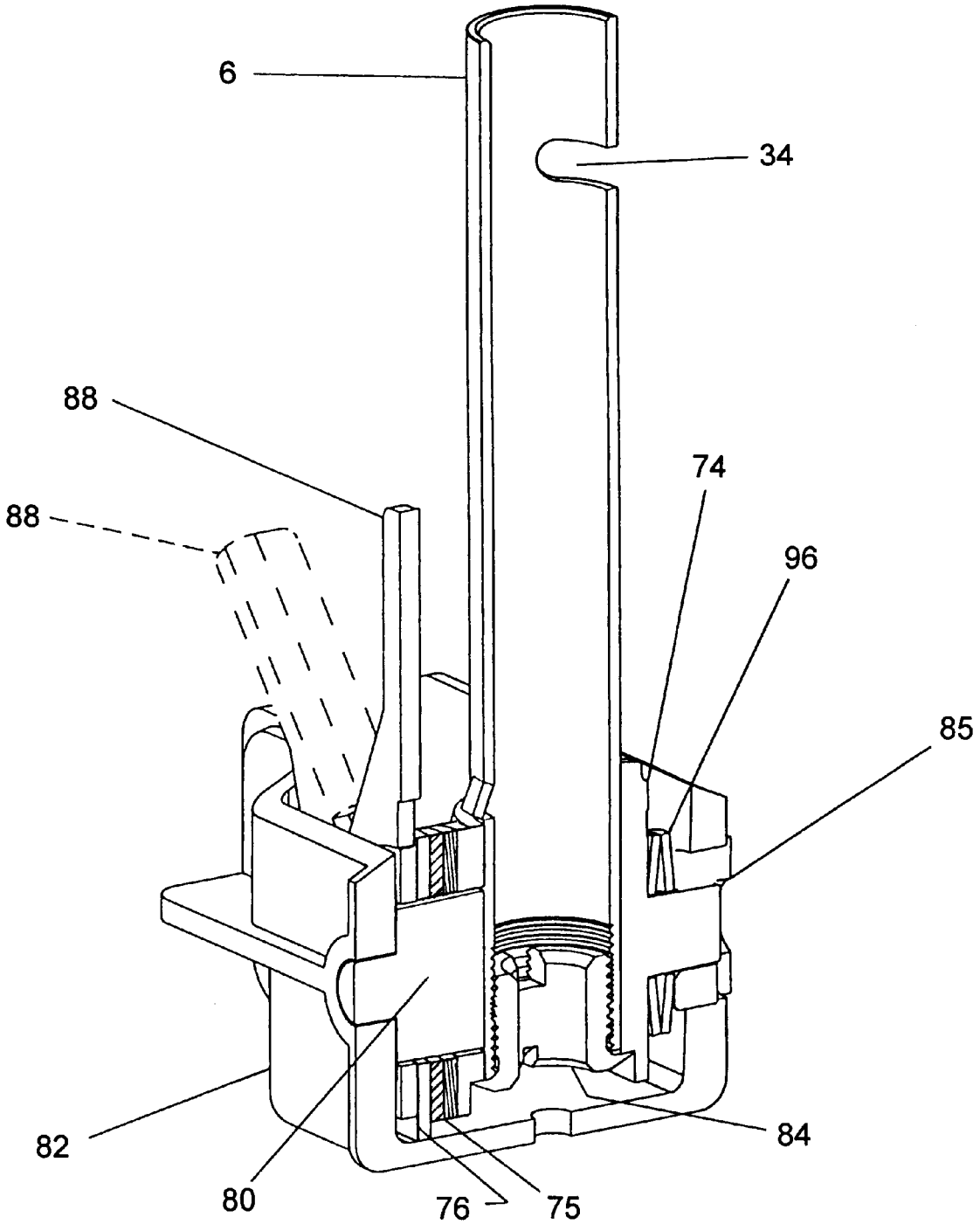
FIG. 11 is a perspective view in cross-section of the locking mechanism of FIG. 9.

Once the lighting fixture is in its desired horizontal and vertical positions, the stem 6 can be locked in place by moving the actuator lever 88 to its locked position shown in the broken lines in FIG. 10 and in the solid lines in FIG. 11. As the lever 88 is moved from its open to its locked position the bumps 90 on lever disk 88 move along the inclined ramps 92 in ramp plate 78. The camming action of the bumps along plate 78 causes the latter to move transversely to the right, as viewed in FIGS. 9 and 11, which, in turn, causes brake linings 75, 76 to come into firm engagement with one another.

The frictional braking force created by the engagement of the brake linings prevents further vertical pivoting of the stem 6, thereby locking the stem in its desired vertical orientation, as indicated by the indicia 100. The inward movement of lever disk 86 also acts through inner barrel 80 to urge stop clamps 72 and 74 against the periphery of stem 6, thereby preventing further horizontal rotation of stem 6 and locking the stem 6 in its preset horizontal orientations.

When the actuator 88 is in its open or unlocked position a minimum tension is still applied to the stem by means of a spring washer 96 to a degree determined by the settling of adjustment bushing 85. This retentive force allows movement of the stem 6 in the vertical and horizontal directions to its desired position but prevents the lighting fixture from swinging freely with respect to the stem.

Figure 12:
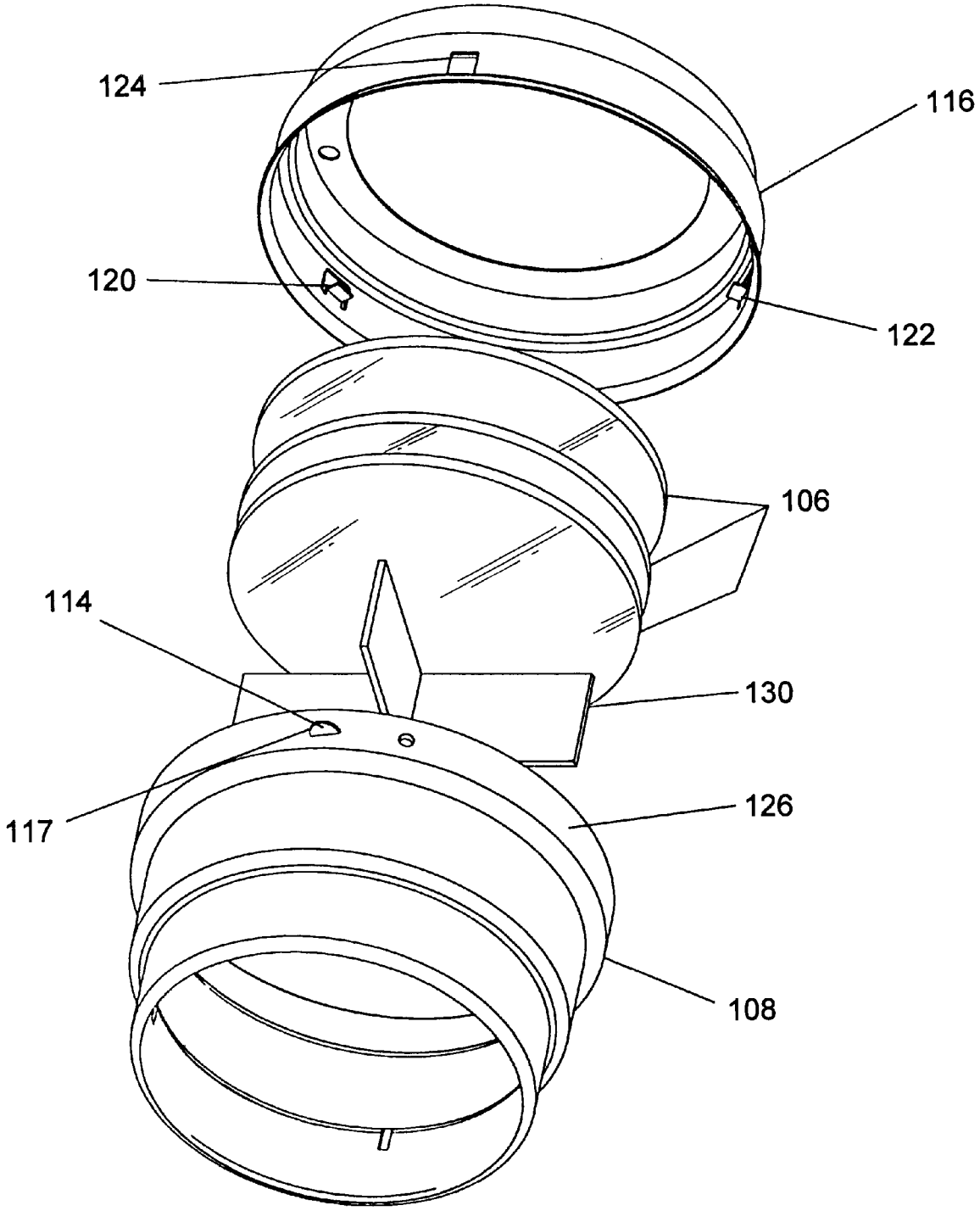
FIGS. 12 and 13 are exploded perspective views of a media accessories cartridge in accordance with the invention.
Figure 13:
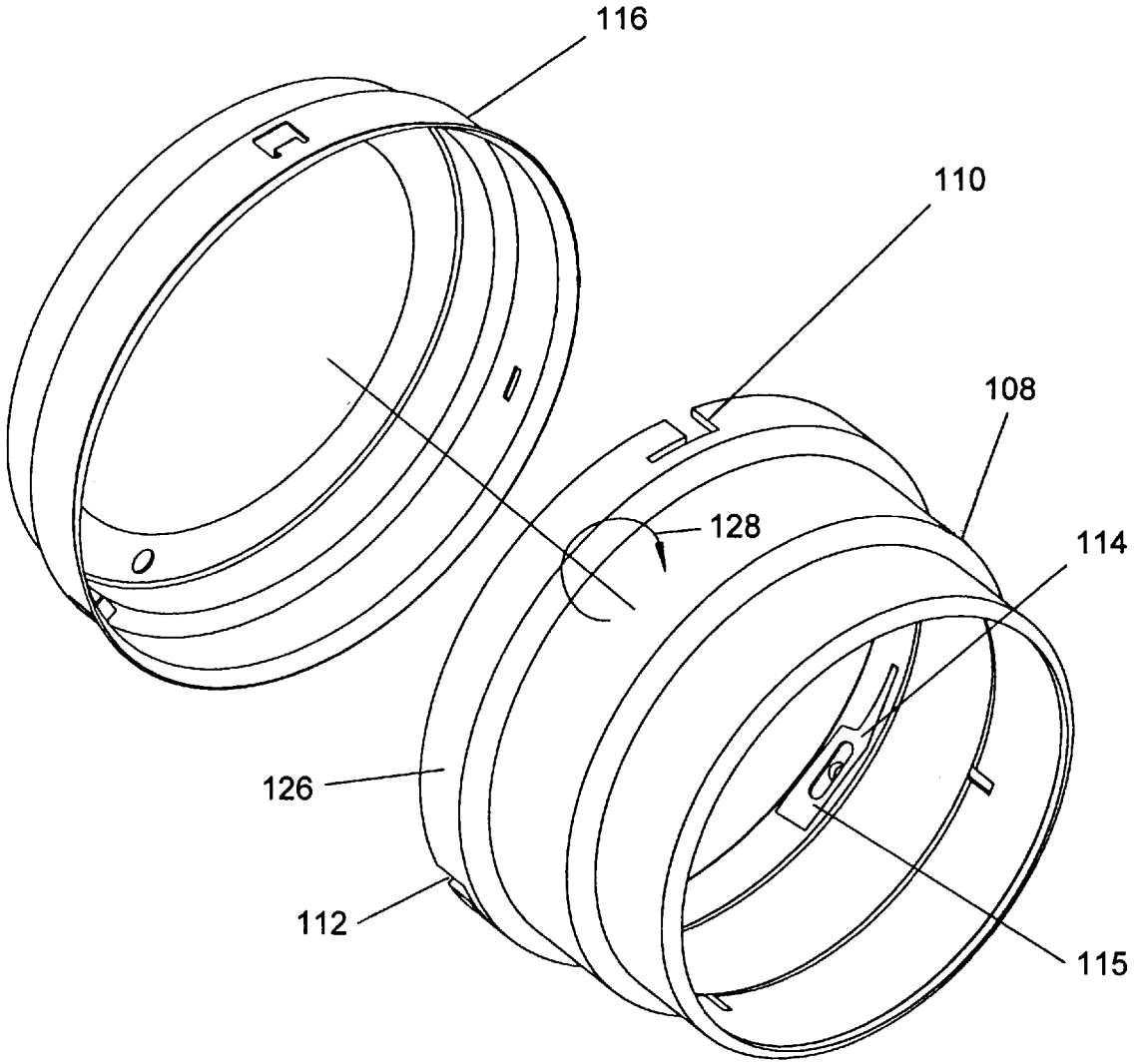

The media cartridge 9, in accordance with the invention, is illustrated in FIGS. 12 and 13. As therein shown a plurality (here three) of media accessories 106 such as, for example, a colored filter, a lens, and a louver are axially spaced within a unitary media cartridge 108, and are retained therein by the use of any suitable means such as a circular wire (not shown) received within the periphery of the cartridge. As seen best in FIG. 13, the media cartridge 108 contains a plurality (here three) of locating and locking means arranged about its periphery. Those locking means in the embodiment illustrated are equiangularly spaced about the cartridge periphery, and include first and second alignment notches 110, 112, and an alignment locking spring 114. The latter includes a resilient arm 115 secured at one end to the interior surface of media cartridge 108 and a tab 117 (FIG. 12) attached to arm 115 and extending through an opening formed in large-diameter section 126. A glare-reducing cross blade 130 is positioned within the forward end of the media cartridge 108.

A cartridge sleeve 116 is mounted within the light fixture and surrounds a lamp 108 shown in broken lines in FIG. 1. As seen in FIGS. 12 and 13, cartridge sleeve 116 includes three equiangularly spaced mating means for the three locating and locking means on the media cartridge 108. Specifically, cartridge sleeve 116 includes fist and second locking means 120, 122, which mate with the alignment notches 110, 112 on the media cartridge 108, and an alignment groove 124 adopted to receive the projecting tab 117 of locking spring 114.

To assemble the media cartridge in the arrangement shown in FIG. 1, the inner, large-diameter section 126 of media cartridge 108 containing the media accessories 106 is inserted into cartridge sleeve 116, until alignment notches 110, 112 on section 126 are engaged in locking tabs 120, 122 on cartridge sleeve 116, and spring tab 117 is received within alignment groove 124. Media cartridge 108 can then be rotated through a small angle in the direction of arrow 128 (FIG. 13) so as to lock the media cartridge in position and thereby prevent undesired relative rotation among the media accessories housed in the media cartridge.

It will be understood from the preceding description of a preferred embodiment that the track lighting fixture of the invention provides a flush attachment of the adapter to the lighting track while achieving secure mechanical and electrical connection between the adapter and the lighting track. It will also be apparent that the lighting fixture can be easily and reliably locked in the desired horizontal and vertical positions by the movement of a single actuator. The fixture of the invention also enables the use of accurately oriented media accessories in a single cartridge inside the lighting fixture. It will further be understood that although the present invention has been described hereinabove with regard to a presently preferred embodiment, variations to this embodiment may become apparent to those of ordinary skill in the art without necessarily departing from the spirit and scope of the invention.

What is claimed is:

1. A fixture adapter for securing a lighting fixture to a lighting track, said adapter comprising a base, at least one actuating member pivotally secured to said base and including a depending engaging member, said actuating member being pivotable between a first position and a second position in which said actuating member lies substantially flush with the lighting track, resilient retention means mounted on said base in operative engagement with said actuating member and movable in response to the pivoting of said actuating member to a locking position in which said resilient retention means frictionally engages the lighting track and said depending engaging member of said actuator member engages the lighting track so as to retain said adapter to the lighting fixture, a stem affixed at its upper end to said base and at its other lower end to a lamp housing, locking means affixed to the lower end of said stem to restrict horizontal and vertical movement of the lamp housing, said locking means including first and second friction plates, and an actuator arm operatively connected to one of said friction plates to cause, when said actuator arm is moved from an open position to a locking position, said one friction plate to move into frictional engagement with the other of said friction plates, thereby to limit movement of the lamp housing in the vertical direction, and first and second clamp means movable upon movement of said actuator arm to its said locking location into operative engagement with said stem, thereby to limit movement thereof in the horizontal direction.

2. The fixture adapter of claim 1, further comprising first cam means connected to said actuator arm and second cam means connected to said one friction plate to cause transverse movement of said one friction plate when said actuator arm is moved to its said locking position.

3. The fixture adapter of claim 2, in which said first cam means includes a plurality of spaced raised surfaces movable along with said actuator arm, and said second cam means includes a cam plate including a corresponding plurality of inclined recesses affixed to said one friction plate for respectively receiving and cooperating with said raised surfaces.

4. The fixture adapter of claim 1, in which said actuating member includes a planar surface and a camming wall section extending from said planar surface and engaging said resilient retention means, said planar surface lying substantially flush with the lower edge of the lighting track when said actuating member is in said second position.

5. The fixture adapter of claim 4, in which said resilient retention means includes a vertical section engaging said wall section and a horizontal arcuate section extending from the upper end of said vertical section.

6. The fixture adapter of claim 5, in which an opening is formed in said base, and comprising a contact post extending through said opening and including first and second spaced electrical contacts, said contact post being movable between a first position in which said contacts come into contact with a power line in the track section, to a second position in which said contacts are electrically disconnected from the power line.

7. The fixture adapter of claim 6, in which said contact post further includes at least one tab adapted to engage the inner wall of the lighting track when said contacts are in their said first position.

8. The fixture adapter of claim 7, further comprising a lever operatively connected to said contact post and rotatable between first and second positions to cause said contact post to move between its said first and second positions.

9. The fixture adapter of claim 8, in which said lever is operable to move said contact post to its first engagement position when said actuating member of said adapter is in its said clamped position.

10. The fixture adapter of claim 1, in which said resilient retention means includes a vertical section engaging said wall section and an arcuate section extending from the upper end of said vertical section.

11. The fixture adapter of claim 10, in which an opening is formed in said base, and comprising a contact post extending through said opening and including first and second spaced electrical contacts, said contact post being movable between a first position in which said contacts come into contact with a power line in the track section, to a second position in which said contacts are electrically disconnected from the power line.

12. The fixture adapter of claim 11, in which said contact post further includes at least one tab adapted to engage the inner wall of the lighting track when said contacts are in their said first position.

13. The fixture adapter of claim 12, further comprising a lever operatively connected to said contact post and rotatable between first and second positions to cause said contact post to be moved between its said first and second positions.

14. In the track lighting fixture of claim 13, in which said lever is operable to move said contact post to its first engagement position when said actuating member of said adapter is in its said clamp position.

15. The fixture adapter of claim 1, in which an opening is formed in said base, and comprising a contact post extending through said opening and including first and second spaced electrical contacts, said contact post being movable between a first position in which said contacts come into contact with a power line in the track section, to a second position in which said contacts are electrically disconnected from the power line.

16. The fixture adapter of claim 15, in which said contact post further includes at least one tab adapted to engage the inner wall of the lighting track when said contacts are in their said first position.

17. The fixture adapter of claim 16, further comprising a lever operatively connected to said contact post and rotatable between first and second positions to cause said contact post to move between its said first and second positions.

18. The fixture adapter of claim 22, in which said lever is operable to move said contact post to its said first position when said actuating member of said adapter is in its said clamp position.

19. In combination with the fixture adapter of claim 1, further comprising a cartridge sleeve secured in the interior of the housing, a media cartridge, a plurality of axially spaced media accessories arranged in said media cartridge at a predetermined angular orientation relative to one another, and corresponding locating and locking means in said cartridge means and in said media cartridge for securing said media cartridge to said cartridge sleeve in a preselected angular relationship.

* * * * *